United States Patent [19]

Noir et al.

[11] 4,118,172

[45] Oct. 3, 1978

[54] METHOD AND APPARATUS FOR CONTROLLING BURNER STOICHIOMETRY

[75] Inventors: Dominique Noir, Nyon, Switzerland; John Meier, San Diego, Calif.

[73] Assignee: Battelle Development Corporation, Columbus, Ohio

[21] Appl. No.: 734,176

[22] Filed: Oct. 20, 1976

[51] Int. Cl.[2] ..... F23N 5/10

[52] U.S. Cl. ..... 431/12; 137/6; 431/90

[58] Field of Search ..... 431/8, 12, 90; 137/6, 137/90

[56] References Cited

U.S. PATENT DOCUMENTS

| | | | |
|---|---|---|---|
| 2,780,414 | 2/1957 | De Heer | 431/12 |
| 3,768,955 | 10/1973 | McLaughlin | 431/12 |

*Primary Examiner*—Edward G. Favors
*Attorney, Agent, or Firm*—Barry S. Bissell

[57] ABSTRACT

The ratio of fuel to oxidant in a gas mixture to main burners in a furnace, wherein the fuel is of variable composition, is controlled to a predetermined level by burning a portion of the fuel in a control burner, adjusting the oxidant to obtain a ratio of fuel to oxidant near the stoichiometric ratio in the control burner and supplying the main burners with independent preset multiples of the fuel and oxidant flow in the control burner such that the predetermined ratio of fuel to oxidant is achieved.

The stoichiometric ratio is determined by automatic searching for the peak value of a burning or burned fuel property which has a maximum value as a function of the fuel/oxidant ratio at or near the stoichiometric ratio. For example, the temperature of the burned fuel is a property which may be used to find the stoichiometric ratio.

The method and apparatus for controlling burner stoichiometry may be used for improving burner efficiency and reducing pollution or it may be used to control the atmosphere of a furnace anywhere between oxidizing and reducing conditions.

3 Claims, 4 Drawing Figures

METHOD AND APPARATUS FOR CONTROLLING BURNER STOICHIOMETRY

BACKGROUND OF THE INVENTION

Maintaining constant temperatures and atmospheres in furnaces, boilers, and other combustion chambers using gaseous hydrocarbons as the source of heat requires the employment of a fuel with a fairly constant composition and heating value and an oxidant (usually air) in definite proportions to the fuel. Worldwide, the use of producer gas, town gas, and other low, variable heating value gases has been superseded by the use of natural gas which has had an acceptably uniform heating value for most uses. However, present changes in natural gas distribution toward large pipeline networks and regasification of liquified natural gas may result in gas with some variation in composition. For most thermal processes the magnitude of the variation may be acceptable; however, in others it may not.

Furthermore, the trend toward coal gasification will once again introduce wider variations and low heating value gas into industrial processes. A number of solutions exist for utilizing these variable heating value gases in thermal processes requiring constant heat. For example, one method involves constantly measuring the changes in temperature produced by the burning fuel of variable calorific value and then varying the mass flow of gaseous fuel to compensate for these changes. This is shown by U.S. Pat. No. 2,780,414 to De Heer wherein the temperature is also observed in an auxiliary burner. Other U.S. Pat. Nos. to Kappel (2,818,246), Andrews (3,407,022), Dailey (2,866,602), and Schmidt (1,849,335; 1,933,641; 2,349,521) disclose various ways of controlling air to fuel ratios in burning zones. However, they are directed mainly to controlling the amount of heat produced and not to controlling stoichiometry of the gas and oxidant as is the present invention.

In ordinary burners wherein the ratio of air to fuel gas is mechanically fixed or wherein the air is admitted by inspiration, the changing of the mass flow of fuel gas to compensate for calorific variations can result in changed burning conditions and atmospheres inside the combustion zones. For example, rich fuel/air mixtures can result in pollutants in the form of unburned hydrocarbons and carbon monoxide and in a reducing atmosphere in the combustion zone. Lean mixtures can result in an oxidizing atmosphere in the combustion zone, excessive nitrogen oxides and in heat losses as a result of having to heat excess air which is then lost in the exhaust.

One present method of controlling the fuel to air ratio consists of measuring the gas composition (particularly the oxygen level) of the exhaust gas with an analyzer and feeding the information back to the feed gas and air lines to compensate for variations. In some processes, however, this remedial type of compensation can be slow, and damage to the products being thermally treated may occur before the change is made. In addition, some analyzers work only on the one side of the stoichiometric ratio.

SUMMARY OF THE INVENTION

It is, therefore, an object of the present invention to provide a solution to the problem of controlling the amount of excess or deficiency of oxidant with respect to the stoichiometric ratio of fuel and oxidant to burners in a combustion zone. The solution is in the way of prevention rather than an attempted remedy of damaging variations in burning conditions caused by variation in fuel composition and heating value (per standard volume of fuel).

It is another object of the invention to provide a method for burning variable calorific value fuel in an efficient manner in installations such as boilers, and in also using the fuel for "non-efficient" combustion, such as in controlled atmosphere furnaces.

In accordance with the objectives, the invention is a method and apparatus for continuously and automatically determining the stoichiometric ratio of oxidant to variable composition fuel in a control burner and continuously supplying the main burners of a combustion zone with preset multiples of the fuel and oxidant flow to the control burner, the preset multiples being related to the deviation from the stoichiometric ratio desired in the combustion zone.

The method for controlling the gaseous fuel to oxidant ratio to a main burner employing variable composition fuel comprises burning quantities of the fuel and oxidant in a control burner, monitoring the change in some property of the burning or burned gases which has a peak value near the stoichiometric fuel to oxidant ratio, adjusting the quantities of fuel or oxidant to the control burner to maximize the monitored property thereby finding the stoichiometric ratio for the oxidant and the instantaneous fuel composition, and supplying the main burner with preset multiples of the fuel and oxidant flow in the control burner. The relative multiples of fuel and oxidant to the main burner are determined from the desired variation from the stoichiometric ratio established in the control burner.

The stoichiometric ratio of fuel to oxidant is found in the control burner by an automatic searching technique of a property of the burned or burning gases which has a peak value as a function of the fuel to oxidant ratio at or near the stoichiometric ratio. One way of automatic searching comprises periodically inducing a variation (or pulse) in the fuel to oxidant ratio of the gases burned in the control burner and comparing the direction of change in the monitored property with the direction of the change in the fuel to oxidant ratio. The deviation from the stoichiometric ratio may be determined from the relative changes of the two variables and a permanent compensating change may be made to the fuel to oxidant ratio before inducing another pulse. Since the monitored property has a maximum value near the stoichiometric ratio, it only remains to continue pulsing to find the maximum value of the property, which is the point where a small pulse results in little or no change in the monitored property.

The above method for controlling burner stoichiometry may be combined with temperature or heat responsive means which can be used to determine the calorific value of the variable fuel and adjust the flow of fuel to the combustion zone to maintain the necessary heat for the thermal conditioning. The above inventive method would then adjust the oxidant flow in response to the change in fuel flow to maintain the predetermined combustion conditions (lean or rich) in the combustion zone. Several rapid iterations of the sequence may be required to keep the combustion zone at both proper temperature and atmosphere.

Apparatus according to the invention comprises elements for practicing the method including a control burner, means for supplying fuel and oxidant to the control burner, means for measuring the burning property in the control burner, means for adjusting the supply of fuel and oxidant to the control burner to achieve the stoichiometric ratio in response to information from the property measuring means and means for supplying the main burner with preset multiples of the fuel and air flow in the control burner.

DETAILED DESCRIPTION OF THE INVENTION

The invention pertains to controlling the stoichiometry of fuel to oxidant to a main burner in a combustion zone. Herein, the term stoichiometry is used in the broad sense to mean the relative proportions of elements and compounds as reactants in the combustion reactions. The stoichiometric ratio is used herein to mean the definite ratio of reactants (fuel to oxidant) which yields complete reaction without excess of any reactant in the products. For example, the stoichiometric ratio (molar) of $CH_4$ to $O_2$ is 1 : 2 according to the balanced reaction $CH_4 + 2O_2 \rightarrow CO_2 + 2H_2O$. The term quantity (of reactants) is also used in a broad sense to include quantity over a period of time or flow rate of reactants. Heating or calorific value implies a standard set of conditions for a specific volume of fuel.

Figure 1:
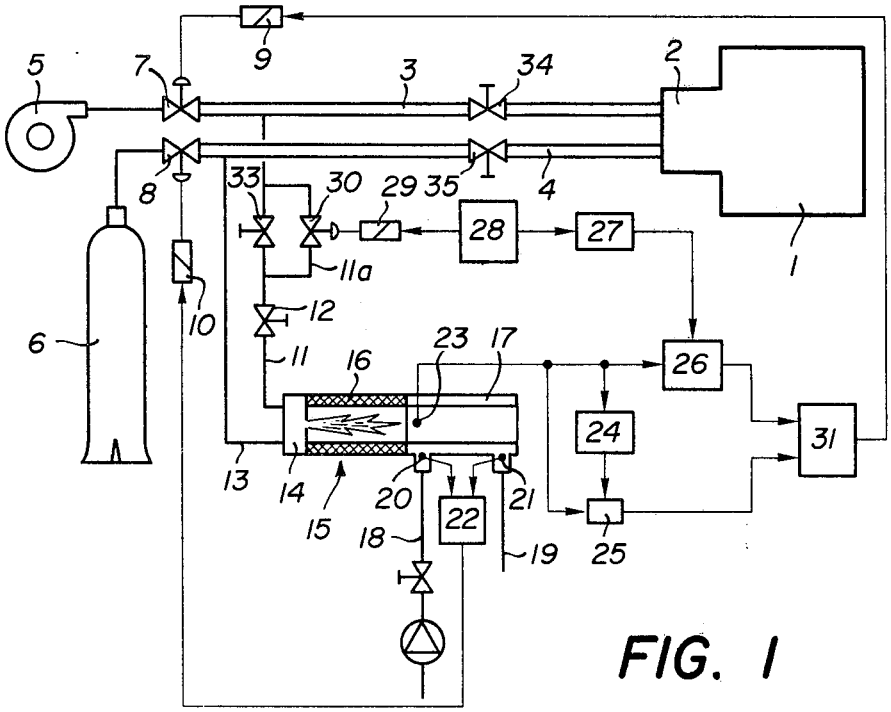
FIG. 1 is a schematic diagram of the stoichiometry control system of the invention combined with a heat control system.

FIG. 1 shows a schematic of apparatus embodying the invention when utilized with a combustion chamber or zone 1 and a source of variable composition fuel 6. The apparatus of FIG. 1 includes a system for keeping constant the heat supplied to the combustion zone by varying fuel flow and the stoichiometry control system of the invention for adjusting the air supply in response to changing fuel flow.

The combustion zone has a main burner 2 and supply lines 3 and 4, respectively connected to an oxidant supply fan 5 and the variable fuel source 6. Valves 7 and 8 control the flow of gases in the supply lines to the main burner. These valves are connected to drive servomotors 9 and 10 which may actuate the valves by means of electromagnets of pneumatics, for example.

The drive servo-motors 9 and 10 are in turn activated by control loops incorporating the rest of the system. The first loop is the stoichiometry control system of the invention and includes drive member 9 and the valve 7 on the air supply line along with the control system hardware to be described hereinafter. The second loop is the heat control system for maintaining constant heat to the combustion chamber. It includes the drive member 10, the valve 8 on the fuel supply line, a calorimeter device 32 for measuring the calorific value of the fuel and therefore the instantaneous power to the combustion chamber, and known data recognition hardware to be hereinafter described for implementing a fuel supply adjustment through the second loop in response to information from the calorimeter. The calorimeter is shown as part of a control burner 15. The control burner includes burner head 14 for admitting fuel and oxidant to the control burner.

Since the general concept of a calorimeter system of fuel control is known in itself, as earlier disclosed, it will not be described in great detail. In general, however, quantities (a fraction of the flow) of air and fuel from the main burner supply lines are directed to the control burner through sampling pipe lines 11 and 13, respectively. The fractional flow of fuel may be fixed by the sampling technique but the air pipe line 13 has appropriate valving 12, 33 for varying the flow of air. Valve 34 and valve 35 are preset to create the necessary pressure drops to insure the flow of air and gas samples through the sampling pipe lines 11 and 13. The larger the impedance of valves 34 and 35, the larger the mass flow rates through the control burner.

The fuel and air are burned in the control burner 15 and the temperature of a fluid (usually water), within hollow sleeve 17 and flowing from an input 18 to an output 19, is recorded by thermocouples 20 and 21. The thermocouple outputs are fed to regulator 22 which compares the temperature difference with a programmed reference value and then activates drive motor 10 to adjust the fuel flow to the main burner, and fractionally to the control burner; through valve 8. The temperature difference is a function of the instantaneous heat flux or power to the combustion chamber from the main burner and, therefore when calibrated, may be used to determine what adjustment in fuel flow is necessary to achieve the desired heat flux.

The objective of the first loop (the stoichiometry control system of the invention) is to adapt the air rate to the combustion chamber to the variations in flow and heating value of the fuel so as to maintain constant combustion and thermal processing conditions in the combustion zone.

This control over the stoichiometry is accomplished by measuring and monitoring, in a control burner, a property of the burning or burned gases which has a maximum or minimum value as a function of the fuel to oxidant ratio near the stoichiometric ratio, adjusting the rate of flow to the control burner to maximize (minimize) the monitored property and supplying the main burner with preset multiples of the flow being fed to the control burner. Excess fuel or oxidant relative to the stoichiometric ratio is provided to the combustion chamber by changing the relative preset multiples of fuel and oxidant.

Figure 2:
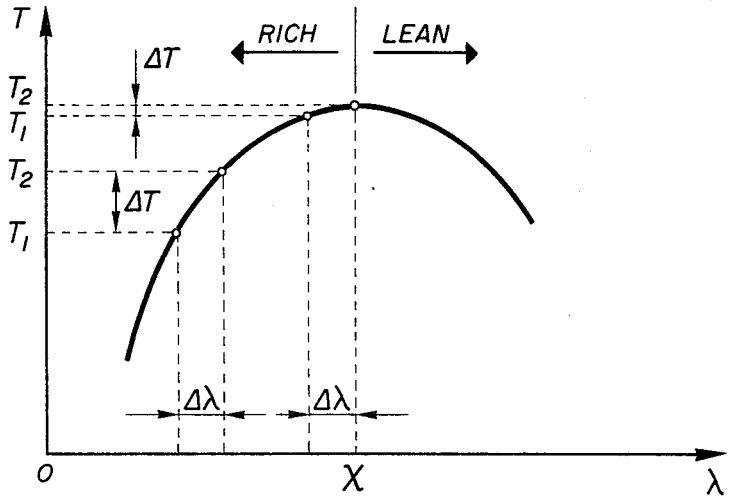
FIG. 2 is a curve of one property (temperature) which has a maximum value near the stoichiometric ratio and which may be monitored in the invention to find the stoichiometric ratio in the control burner.

In the system of FIG. 1, temperature of the burning gases is chosen as the monitored property and the control burner 15 is utilized as the location of monitoring the property. As seen in FIG. 2, temperature of burning gases has a peak value as a function of oxidant to fuel ratio ($\lambda$) at or near the stoichiometric ratio ($\chi$).

The stoichiometry control system of FIG. 1 includes a thermocouple 23 placed at the extreme end of a refractory sleeve 16 and a short distance from the tip of the flame. The temperature is monitored at a location upstream of the calorimeter portion which extracts heat from the burned gases. The thermocouple 23 is connected to a control circuit including a filter 24, a comparator 25, an algebraic multiplier 26, and a control element 31 of the drive member 9, which ultimately controls valve 7 on the air supply line. This type of electronic control circuit and these control devices are well known in the art and by themselves form no part of the inventive process. Their use will be described hereinafter.

The above electronic circuit is designed for monitoring the property of burning gases and it acts in cooperation with the circuit for inducing a variation in the fuel to air ratio, for together searching the property function to find the maximum value as a function of fuel to air ratio. The circuit for inducing a variation also comprises well-known elements such as a wave generator 28, an electromagnet 29, which controls valve 30 for pulsing the air flow in pipe 11*a* to the control burner, and delay member 27 which connects with the algebraic multiplier 26. Valve 33 cooperates with valve 30 to determine the amplitude of the air flow rate fluctuations. The impedance of valve 33 is much smaller than the impedance of valve 30, so that the amplitude of the fluctuations is much smaller than the average flow rate through valve 33. Valve 33 is then preset before calibration of the sampling system.

The system of FIG. 1 operates in the following manner. Initially, since the flows of fuel and air to the main burner are proportional to the flows in the control burner, it is necessary to "preset the multiples" of the stoichiometric flow to the control burner which are desired in the combustion chamber. For example, if excess air is desired in the main burner, then the multiple of the air flow will be preset greater than the multiple of the fuel flow. The exact multiples may be arrived at by calibrating the system using a reference fuel (a fuel with constant, known properties) and an oxygen analyzer (for lean conditions) in the exhaust from the combustion zone. The main burner 2 is thus fed with the reference fuel, the quantity of oxygen in the exhaust is measured and the valve 7 is adjusted to provide the desired excess air (or excess gas). Once this rate of air is fixed, the flame temperature in the control burner is maximized by varying the air flow in sampling pipe line 11 using control valve 12, and taking care that the fuel flow stays constant until the flame temperature has reached a maximum. During this calibration the valve 30 is half open to simulate the average rate of air flow to the control burner during the searching operation of the invention. A closer approximation can be made by determining what percentage of time the valve is open during operation and then opening the valve this percentage during calibration. At this stage, the system is calibrated to provide the desired atmosphere in the combustion zone relative to the combustion conditions in the control burner, and valve 12 should, therefore, be locked in position.

This calibration operation may be carried out during the initial operation of the apparatus and may be checked intermittently thereafter. It is important to note that during the calibration, the regulator 22 and the thermocouple 23 must be disconnected from the control loops.

After calibration, the whole system is made operational and the main burner and control burner are provided with gas flow. The gases are burned in both burners and the control of heat input to the combustion chamber is provided by control of the fuel flow with the previously described calorimeter system wherein the regulator 22 causes the servo-motor 10 to actuate valve 8 in response to the difference in the temperature drop across the calorimeter and the reference temperature drop programmed in the regulator.

The stoichiometry control system of the invention operates concurrently with the heat control loop. In operation, the thermocouple 23 measures the flame temperature in the control burner. However, since the fuel heating value is varying (though slowly relative to the pulses in the flow), the temperature at the stoichiometric ratio is also varying so that the important measurement is the relative maximum temperature as a function of fuel to air ratio rather than the absolute temperature itself. To find this maximum, the system searches the temperature versus fuel to air curve for the peak value. The wave generator 28 feeds the electromagnet 29 by signals of a certain frequency, for example as illustrated by the diagrams 3*a* and 4*a* shown in FIGS. 3 and 4. The value 30 is normally closed so that the signals actuate the electromagnet to open valve 30, the letters O and F of diagram 3*a* signifying, respectively, the open and closed state of the valve. The result of this operation is that the flow of air in the pipe 11 fluctuates at the signal frequency shown in diagram 3*a* and induces a periodic variation at a constant amplitude $\Delta\lambda$ of the air to fuel ratio introduced into the control burner. The diagram shown in FIG. 2 illustrates the effect of these variations $\Delta\lambda$ on the temperature variation $\Delta T$. It is seen that the closer the air to fuel ratio is to $\chi$, i.e., to the stoichiometric ratio, the lower the magnitude of $\Delta T$, both when there is a deficiency and an excess of air, the curve being symmetrical with respect to the stoichiometric ratio.

However, the slope of the tangents to the curve of FIG. 2 change sign according to whether the gas mixture is rich or lean. In practice, this change of slope has the following significance; if $\lambda < \chi$ then $T_1 < T_2$ when the air to fuel ratio increases by $\Delta\lambda$. On the other hand, when $\lambda > \chi$, $T_1 > T_2$ for the same increase in $\lambda$.

Figure 3:
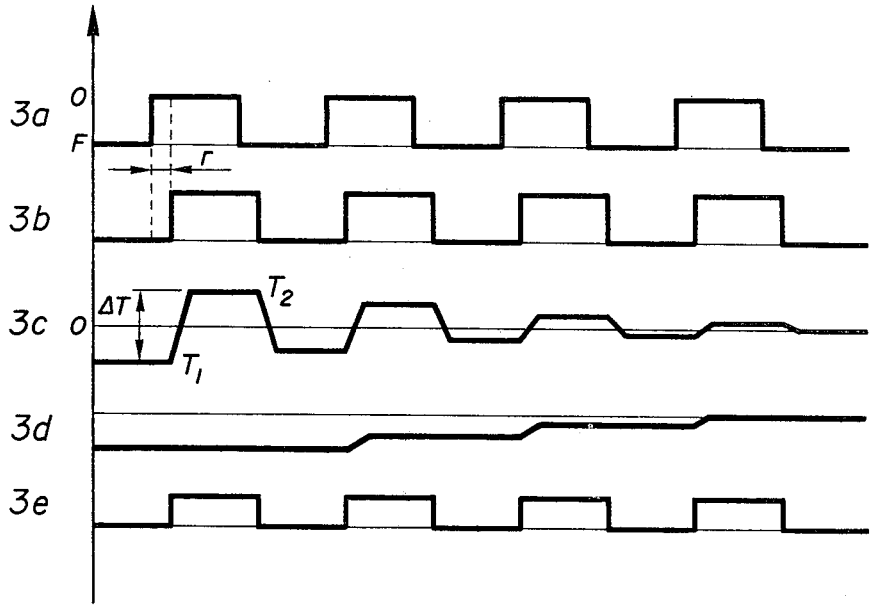
FIGS. 3 and 4 are representations showing the cause (pulse) and effect (temperature change) in the control burner as the control method is practiced using temperature as the monitored property. The diagrams also show the outputs of other electronic control elements in the system.

The functional diagram of FIG. 3 illustrates the case in which $\lambda < \chi$. When the valve 30 opens, $T_2$ becomes greater than $T_1$ (see diagram 3*c*). The time lag between the opening valve 30 and the increase in temperature is due to the reaction time of the control burner-thermocouple assembly. Consequently, the signal of the generator 28 may be transmitted by element 27 to the algebraic multiplier 26 with a certain time delay "*r*", as illustrated by diagram 3*b*.

The principal function of the multiplier 26 is to generate positive signals if $\Delta T$ increases when valve 30 opens, and negative signals if $\Delta T$ decreases when the valve opens. In the example given in FIG. 3, the multiplier signals, illustrated by diagram 3*e* are positive and are transmitted to one of the two terminals of the control element 31. The second terminal of this element receives the signal shown in diagram 3*d* which is given by the comparator 25 and which is proportional to the difference between the average of the fluctuations in temperature (established by filter 24), and the actual instantaneous level of the fluctuation. The signal "*d*" indicates to the control element 31 the size of the correction to be made, while the signal "*e*" indicates the direction of that correction. $\Delta T = 0$ would signify that the flame temperature was equal to $T_{max}$, i.e., that $\lambda = \chi$.

The control element 31 acts through the drive member 9 on the valve 7 which controls the air flow in supply line 3. This adjustment of the rate of air to the control burner 15 also causes an adjustment in rate of air to the combustion chamber burner 2 in accordance with the initially calibrated preset multiple.

Figure 4:
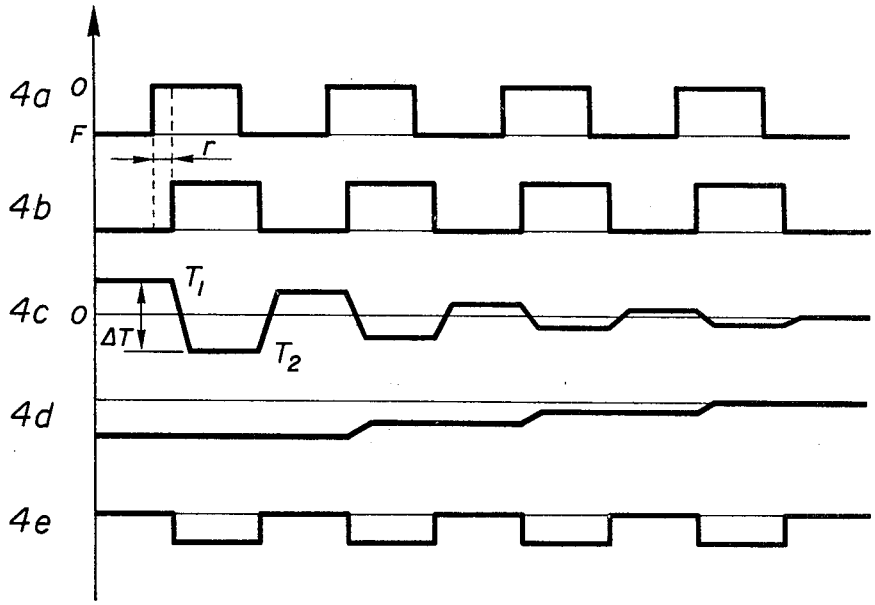

FIG. 4 illustrates a correction when $\lambda < \chi$. The symmetry with respect to FIG. 3 is seen, T decreasing instead of increasing when valve 30 is opened by the signal "*a*", and the algebraic multiplier 26 producing a negative signal "*e*".

Once again, it is emphasized that the apparatus utilized in the invention are generally known. The invention is the combination of the elements and steps which allows the maintenance of constant combustion conditions when using variable composition fuels without the time and expense of measuring the mass flow of the fuel or the fuel composition.

As alternatives in the above described example of the invention it is possible and sometimes desirable to monitor a property other than temperature in the stoichiometry control loop. For example, other properties which have peak values, as a function of the fuel to oxidant ratio, near the stoichiometric ratio include: the amount of water vapor or carbon dioxide in the burned gases, the degree of ionization in the burned gases, flash-back velocity gradient, blow-off velocity gradient, heat flux and quenching distance. The latter property has a minimum value near the stoichiometric ratio, and the search technique can be used to find the minimum value of the property or the maximum of the inverse property.

Instruments for measuring these properties and others are well-known in the art. Such measurements might be more desirable than temperature because of the lag in the response time and the poisoning of the thermocouple during the temperature measurement.

In the searching operation it is equally possible to pulse the fuel flow rather than the air flow. The temperature variation should then vary in the opposite direction to the variation caused by an air pulse.

Additionally, the shape of the signal from the wave generator need not be a square wave as shown in FIGS. 3 and 4. Any output which is sufficient to periodically pulse the flow of fuel or oxidant to the control burner according to the invention is sufficient to function in the system.

The heat control loop with the calorimeter was described as functioning by adjusting the fuel in response to variable heating value gas. Actually, this loop might also adjust the air to a first approximation and then allow the stoichiometry control loop to fine tune the air flow. This would be useful for programmed changes in the heat flux demand to the combustion chamber.

The above described control system is useful in combustion systems wherein thermal processing requires critical atmospheric conditions. It is also useful in thermal processes requiring reducing or non-oxidizing atmospheres, and it is useful in any systems where conservation of fuels through efficient combustion is desired. These uses suggest several possible systems, for example, large-scale atmosphere gas generators, catalytic reformers for hydrogen production, gaseous feedstock control systems in chemical and petrochemical industries such as ammonia production, refinery heater combustion systems using refinery off-gases as fuel and industrial boilers fired by large single burners or separately piped multiple burners.

We claim:

1. A method for continuously controlling a gaseous mixture comprising an oxidant and a fuel of variable composition or variable heating value to a predetermined stoichiometry in a main burner comprising, (A) burning a quantity of the fuel and the oxidant in a control burner in parallel with said main burner, (B) monitoring the change in magnitude of a property of the burning or the burned fuel and oxidant in the control burner, said property having a maximum value as a function of the fuel to oxidant ratio at about the stoichiometric ratio, (C) adjusting the fuel to oxidant ratio to the control burner to substantially maximize the magnitude of the monitored property by the steps comprising (a) periodically inducing a variation in the fuel to oxidant ratio in the control burner, (b) measuring the direction of the change in the magnitude of the monitored property, (c) comparing the direction of the change in the magnitude of the monitored property with the variation in fuel to oxidant ratio to the control burner whereby to determine whether the change in magnitude of the monitored property is characteristic of an excess of fuel or oxidant with respect to the stoichiometric ratio, (d) varying the quantity of fuel or oxidant in the control burner to substantially eliminate the excess of fuel or oxidant with respect to the stoichiometric ratio, and (D) simultaneously supplying said main burner with independent, preset multiples of the quantity of fuel and the quantity of oxidant in the control burner such that said predetermined stoichiometry to the main burner is maintained.

2. The method for providing a predetermined instantaneous excess air and maintaining a predetermined temperature output in a main burner fed with a gaseous mixture of a quantity of air and a quantity of a variable composition or variable heating value fuel comprising the steps of:

(A) burning a fixed fraction of the quantity of fuel and a fixed fraction of the quantity of air in a control burner, such fixed fractions of fuel and air being related such that for a reference fuel the fixed fractions of fuel and air are in stoichiometric ratio when the quantity of air to the main burner is in predetermined excess to the quantity of fuel to the main burner.

(B) measuring the temperature produced by the burning in the control burner, (C) adjusting the quantity of fuel fed to the main burner such that the difference in the predetermined temperature and the temperature produced in the control burner is substantially eliminated, (D) monitoring the magnitude of a property of the burning or the burned fuel and air in the control burner, said monitored property having a maximum value as a function of the fuel to air ratio at about the stoichiometric ratio, (E) adjusting the fuel to air ratio to the control burner to substantially maximize the magnitude of the monitored property by the steps comprising (a) periodically inducing a variation in the fuel to air ratio to the control burner, (b) measuring the direction of the change in the magnitude of the monitored property, (c) comparing the direction of the change in the monitored property with the variation in the fuel to air ratio to the control burner whereby to determine whether the change in magnitude of the monitored property is characteristic of an excess of fuel or air with respect to the stoichiometric ratio, and (d) varying the quantity of fuel or air to the main burner to proportionally vary the quantity of fuel or air to the control burner to substantially eliminate the excess of fuel or air with respect to the stoichiometric ratio.

3. Apparatus for continuously controlling a gaseous mixture comprising an oxidant and a variable composition or variable heating value fuel to a predetermined stoichiometry in a main burner comprising, (A) a control burner separate from and in parallel with the main burner, (B) means for supplying metered quantities of fuel and oxidant to the control burner, (C) means for monitoring the change in magnitude of a property of burning or burned quantities of fuel and oxidant in the control burner, said property having a maximum value as a function of the fuel to oxidant ratio at about the stoichiometric ratio, (D) means for adjusting the fuel to oxidant ratio to about the stoichiometric ratio in the control burner in response to information from the means for monitoring said property in the control burner comprising (a) means for periodically inducing a variation of the fuel to oxidant ratio in the control burner, (b) means for comparing the direction of the change in the magnitude of the monitored property with the variation in the fuel to oxidant ratio in the control burner whereby to determine whether the change in magnitude of the monitored property is characteristic of an excess of fuel or oxidant with respect to the stoichiometric ratio, and (c) means for varying the fuel to oxidant ratio in the control burner for reducing the excess of fuel or oxidant with respect to the stoichiometric ratio in response to information from the means for comparing, and (E) means for simultaneously supplying the main burner with independent, preset multiples of the quantity of fuel and the quantity of oxidant in the control burner such that said predetermined stoichiometry to the main burner is maintained.

* * * * *